US010485062B2

(12) United States Patent
Harrison et al.

(10) Patent No.: US 10,485,062 B2
(45) **Date of Patent: *Nov. 19, 2019**

(54) LED POWER-SUPPLY DETECTION AND CONTROL

(75) Inventors: Daniel J. Harrison, Nederland, CO (US); Steven S. Davis, Boulder, CO (US)

(73) Assignee: LEDVANCE LLC, Wilmington, MA (US)

( * ) Notice: Subject to any disclaimer, the term of this patent is extended or adjusted under 35 U.S.C. 154(b) by 964 days.

This patent is subject to a terminal disclaimer.

(21) Appl. No.: 12/948,586

(22) Filed: Nov. 17, 2010

(65) Prior Publication Data

US 2011/0121751 A1 May 26, 2011

Related U.S. Application Data

(60) Provisional application No. 61/261,991, filed on Nov. 17, 2009.

(51) Int. Cl.
*H05B 33/08* (2006.01)

(52) U.S. Cl.
CPC ..... *H05B 33/0815* (2013.01); *H05B 33/089* (2013.01)

(58) Field of Classification Search
CPC .... H05B 37/02; H05B 33/08; H05B 33/0812; H05B 33/0815; H05B 33/0845; H05B 33/0854; H05B 33/089
USPC ..... 315/86, 308, 151–158, 209 R, 224–226, 315/291, 294, 307, 312
See application file for complete search history.

(56) References Cited

U.S. PATENT DOCUMENTS

| | | | | |
|---|---|---|---|---|
| 4,085,403 | A | | 4/1978 | Meier et al. |
| 4,529,949 | A | | 7/1985 | De Wit et al. |
| 4,633,161 | A | | 12/1986 | Callahan |
| 5,291,607 | A | | 3/1994 | Ristic et al. |
| 5,334,916 | A | | 8/1994 | Noguchi |
| 5,401,099 | A | | 3/1995 | Nishizawa et al. |
| 5,485,576 | A | | 1/1996 | Fee et al. |
| 5,506,490 | A | | 4/1996 | DeMuro |
| 5,546,041 | A | | 8/1996 | Szajda |
| 5,606,510 | A | * | 2/1997 | Glaser et al. ..... 702/60 |
| 5,661,645 | A | * | 8/1997 | Hochstein ..... 363/89 |
| 5,691,605 | A | | 11/1997 | Xia et al. |
| 5,781,040 | A | | 7/1998 | Myers |
| 5,783,909 | A | | 7/1998 | Hochstein |

(Continued)

FOREIGN PATENT DOCUMENTS

| | | | |
|---|---|---|---|
| AU | 2010204851 | A1 | 7/2011 |
| AU | 2010363633 | A1 | 7/2012 |

(Continued)

OTHER PUBLICATIONS

U.S. Appl. No. 12/683,393, filed Jan. 6, 2010, by Catalano et al.

(Continued)

*Primary Examiner* — Jimmy T Vu
(74) *Attorney, Agent, or Firm* — Neugeboren O'Dowd PC

(57) ABSTRACT

A circuit detects the type of a power supply driving an LED by analyzing a signal received from the power supply. The circuit controls a behavior of the LED, such as its reaction to a dimmer or to thermal conditions, based on the determined type.

8 Claims, 6 Drawing Sheets

(56) References Cited

U.S. PATENT DOCUMENTS 5,925,990 A 7/1999 Crouse et al.
5,942,860 A * 8/1999 Huynh ..... 315/307
6,069,457 A * 5/2000 Bogdan ..... 315/291
6,153,985 A 11/2000 Grossman
6,225,759 B1 * 5/2001 Bogdan et al. ..... 315/291
6,313,589 B1 11/2001 Kobayashi et al.
6,332,710 B1 12/2001 Aslan et al.
6,351,079 B1 2/2002 Willis
6,382,812 B1 5/2002 Hsu
6,429,598 B1 * 8/2002 Haley ..... 315/141
6,459,257 B1 * 10/2002 Kock ..... 324/142
6,515,437 B1 * 2/2003 Zinkler et al. ..... 315/312
6,693,394 B1 2/2004 Guo et al.
6,713,974 B2 3/2004 Patchornick et al.
6,762,629 B2 7/2004 Tam et al.
6,842,668 B2 1/2005 Carson et al.
6,870,325 B2 3/2005 Bushell et al.
6,930,737 B2 8/2005 Weindorf et al.
7,029,145 B2 4/2006 Frederick
7,034,507 B2 4/2006 Lovett
7,049,765 B1 5/2006 Tremaine, Sr.
7,119,498 B2 10/2006 Baldwin et al.
7,126,290 B2 10/2006 Elliot
7,150,561 B1 12/2006 D'Aquino et al.
7,186,000 B2 3/2007 Lebens et al.
7,196,481 B2 3/2007 Bushell et al.
7,204,638 B2 4/2007 Hsu et al.
7,233,258 B1 6/2007 Gelinas
7,242,150 B2 7/2007 DeJonge et al.
7,245,089 B2 7/2007 Yang
7,245,090 B2 7/2007 Yang
7,262,559 B2 8/2007 Tripathi et al.
7,286,123 B2 10/2007 Yang
7,322,718 B2 1/2008 Setomoto et al.
7,336,434 B2 2/2008 Lille et al.
7,344,279 B2 * 3/2008 Mueller et al. ..... 362/294
7,358,679 B2 4/2008 Lys et al.
7,423,750 B2 9/2008 Hoshizaki et al.
7,429,129 B2 9/2008 St. Pierre et al.
7,330,002 B2 12/2008 Joung
7,486,030 B1 2/2009 Biggs
7,492,108 B2 2/2009 Garcia et al.
7,504,781 B2 3/2009 Wendt et al.
7,504,783 B2 3/2009 Zarr
7,507,001 B2 3/2009 Kit
7,546,473 B2 6/2009 Newman
7,556,423 B2 7/2009 Caliboso
7,605,550 B2 10/2009 Ferentz et al.
7,612,506 B1 11/2009 Yang et al.
7,626,346 B2 12/2009 Scilla
7,628,507 B2 12/2009 Allen et al.
7,633,326 B2 12/2009 Okajima
7,635,957 B2 12/2009 Tripathi et al.
7,656,307 B2 2/2010 Yatsuda et al.
7,656,371 B2 2/2010 Shimizu et al.
7,728,401 B2 6/2010 Takatori
7,755,513 B2 7/2010 Wang et al.
7,777,430 B2 8/2010 Catalano et al.
7,791,326 B2 9/2010 Dahlman et al.
7,792,167 B2 9/2010 Kanesaka
7,800,316 B2 9/2010 Haug
7,800,567 B2 9/2010 Fujino
7,812,551 B2 10/2010 Hite et al.
7,817,009 B2 10/2010 Wang et al.
7,888,623 B2 2/2011 Kawashima et al.
7,888,877 B2 2/2011 Tsai et al.
7,888,942 B2 2/2011 Chen et al.
7,892,870 B2 2/2011 Shi
7,911,156 B2 3/2011 Cottongim et al.
7,911,438 B2 3/2011 Okazaki
7,947,947 B2 3/2011 Ackermann et al.
7,948,190 B2 5/2011 Grajcar
7,948,398 B2 5/2011 Miller
7,986,112 B2 7/2011 West
7,990,077 B2 8/2011 Yu et al.
7,994,725 B2 8/2011 Bouchard
8,358,085 B2 1/2013 Catalano et al.
8,476,847 B2 7/2013 Riesebosch
8,686,666 B2 4/2014 Catalano et al.
8,791,655 B2 7/2014 Sadwick et al.
8,896,231 B2 11/2014 Brandt
9,161,415 B2 10/2015 Catalano et al.
9,326,346 B2 4/2016 Catalano et al.
9,560,711 B2 1/2017 Catalano et al.
9,668,306 B2 5/2017 Harrison et al.
2002/0048177 A1 4/2002 Rahm et al.
2003/0015973 A1 1/2003 Ovens et al.
2003/0052658 A1 * 3/2003 Baretich et al. ..... 323/284
2003/0123521 A1 7/2003 Luoma
2004/0032221 A1 2/2004 Bushnell et al.
2004/0164688 A1 8/2004 Van Tichelen et al.
2005/0057184 A1 3/2005 Kaneko et al.
2005/0057187 A1 * 3/2005 Catalano ..... 315/291
2005/0062481 A1 3/2005 Vaughn et al.
2005/0237005 A1 * 10/2005 Maxik ..... 315/247
2006/0038661 A1 2/2006 Reinhold et al.
2006/0057184 A1 3/2006 Nycz et al.
2006/0119288 A1 6/2006 Ayala et al.
2006/0123521 P1 6/2006 Stemkens
2006/0125773 A1 6/2006 Ichikawa et al.
2006/0152204 A1 7/2006 Maksimovic et al.
2006/0214876 A1 9/2006 Jendbro et al.
2006/0237636 A1 10/2006 Lyons et al.
2006/0238169 A1 10/2006 Baker
2006/0273741 A1 * 12/2006 Stalker, III ..... 315/291
2007/0040512 A1 2/2007 Jungwirth et al.
2007/0040518 A1 2/2007 Young
2007/0057902 A1 3/2007 Joung et al.
2007/0069656 A1 * 3/2007 Huang ..... 315/86
2007/0121324 A1 5/2007 Nakano
2007/0273290 A1 11/2007 Ashdown et al.
2007/0285031 A1 12/2007 Shteynberg et al.
2007/0291483 A1 12/2007 Lys
2008/0018261 A1 1/2008 Kastner
2008/0062070 A1 3/2008 De Oto et al.
2008/0088557 A1 4/2008 Choi
2008/0111505 A1 5/2008 Wang et al.
2008/0122422 A1 5/2008 Zhang et al.
2008/0136334 A1 6/2008 Robinson et al.
2008/0150442 A1 * 6/2008 Feldtkeller ..... 315/209 R
2008/0151965 A1 6/2008 Kim
2008/0180414 A1 7/2008 Fung et al.
2008/0198613 A1 8/2008 Cruickshank
2008/0203992 A1 8/2008 Qahouq et al.
2008/0204884 A1 8/2008 Jang
2008/0215279 A1 9/2008 Salsbury et al.
2008/0224633 A1 9/2008 Melanson et al.
2008/0231198 A1 9/2008 Zarr
2008/0238340 A1 10/2008 Leung et al.
2008/0258636 A1 10/2008 Shih et al.
2008/0287742 A1 11/2008 St. George et al.
2008/0319690 A1 12/2008 Meadows et al.
2009/0021178 A1 1/2009 Furukawa et al.
2009/0021955 A1 1/2009 Kuang et al.
2009/0033612 A1 2/2009 Roberts et al.
2009/0079362 A1 3/2009 Shteynberg et al.
2009/0097244 A1 4/2009 Lan et al.
2009/0146584 A1 6/2009 Ye et al.
2009/0154525 A1 6/2009 Dai et al.
2009/0167203 A1 7/2009 Dahlman et al.
2009/0179574 A1 7/2009 Chang
2009/0179848 A1 7/2009 Schmidt et al.
2009/0212736 A1 8/2009 Baarman et al.
2009/0251059 A1 10/2009 Veltman
2009/0267523 A1 10/2009 Phillips
2009/0289965 A1 11/2009 Kurokawa et al.
2009/0302783 A1 12/2009 Wang et al.
2009/0306912 A1 12/2009 Chen et al.
2010/0007588 A1 1/2010 Zygmunt et al.
2010/0033095 A1 2/2010 Sadwick
2010/0033112 A1 2/2010 Yen
2010/0039049 A1 2/2010 Hoffman
2010/0066270 A1 3/2010 Yang et al.
2010/0118057 A1 5/2010 Atkins et al.

(56) References Cited

U.S. PATENT DOCUMENTS

| | | | | |
|---|---|---|---|---|
| 2010/0134020 | A1 | 6/2010 | Peng et al. | |
| 2010/0157583 | A1 | 6/2010 | Nakajima | |
| 2010/0176734 | A1 | 7/2010 | Haubmann | |
| 2010/0176746 | A1 | 7/2010 | Catalano et al. | |
| 2010/0194368 | A1 | 8/2010 | Taylor et al. | |
| 2010/0203465 | A1 | 8/2010 | Bria et al. | |
| 2010/0225170 | A1* | 9/2010 | Hjort et al. | 307/65 |
| 2010/0237787 | A1 | 9/2010 | Vogler et al. | |
| 2010/0244701 | A1 | 9/2010 | Chen et al. | |
| 2010/0259191 | A1 | 10/2010 | Ghanem et al. | |
| 2010/0264795 | A1 | 10/2010 | Miao | |
| 2010/0277077 | A1 | 11/2010 | Pong et al. | |
| 2010/0283397 | A1 | 11/2010 | Chen et al. | |
| 2010/0295474 | A1 | 11/2010 | Chemel et al. | |
| 2010/0295688 | A1 | 12/2010 | Wu et al. | |
| 2010/0301751 | A1* | 12/2010 | Chobot et al. | 315/86 |
| 2010/0320939 | A1 | 12/2010 | Lai | |
| 2010/0327872 | A1 | 12/2010 | Chen et al. | |
| 2011/0001438 | A1 | 1/2011 | Chemel et al. | |
| 2011/0019430 | A1 | 2/2011 | Wilkinson et al. | |
| 2011/0031903 | A1 | 2/2011 | Nguyen Hoang et al. | |
| 2011/0038715 | A1 | 2/2011 | Frank et al. | |
| 2011/0080099 | A1 | 4/2011 | Teng et al. | |
| 2011/0089852 | A1 | 4/2011 | Segan | |
| 2011/0043120 | A1 | 5/2011 | Panagotacos et al. | |
| 2011/0062895 | A1 | 5/2011 | Ji | |
| 2011/0109231 | A1 | 5/2011 | Shiu et al. | |
| 2011/0115396 | A1 | 5/2011 | Horvath et al. | |
| 2011/0115399 | A1 | 5/2011 | Sadwick et al. | |
| 2011/0115400 | A1* | 5/2011 | Harrison | H05B 33/0815 315/287 |
| 2011/0115645 | A1 | 5/2011 | Hall et al. | |
| 2011/0121744 | A1 | 5/2011 | Salvestrini et al. | |
| 2011/0121751 | A1 | 5/2011 | Harrison et al. | |
| 2011/0121760 | A1 | 5/2011 | Harrison et al. | |
| 2011/0147466 | A1 | 6/2011 | Kang et al. | |
| 2011/0150028 | A1 | 6/2011 | Nguyen Hoang et al. | |
| 2011/0156593 | A1 | 6/2011 | De Greef et al. | |
| 2011/0157238 | A1 | 6/2011 | Lin et al. | |
| 2011/0163696 | A1 | 7/2011 | Huang et al. | |
| 2011/0199013 | A1 | 8/2011 | Cottrell | |
| 2012/0001548 | A1* | 1/2012 | Recker et al. | 315/86 |
| 2012/0068618 | A1 | 3/2012 | Koski et al. | |
| 2012/0268040 | A1 | 10/2012 | Riesebosch | |
| 2012/0299481 | A1 | 11/2012 | Stevens et al. | |
| 2012/0326623 | A1 | 12/2012 | Fatt et al. | |
| 2013/0082610 | A1 | 4/2013 | Bradford | |
| 2013/0182744 | A1 | 7/2013 | Catalano et al. | |
| 2014/0009082 | A1* | 1/2014 | King | H05B 37/02 315/247 |
| 2014/0217896 | A1 | 8/2014 | Catalano et al. | |
| 2014/0306609 | A1 | 10/2014 | Kang et al. | |
| 2014/0368130 | A1 | 12/2014 | Catalano et al. | |

FOREIGN PATENT DOCUMENTS

| | | | | |
|---|---|---|---|---|
| CN | 2924996 | Y | 7/2007 | |
| CN | 101049050 | A | 10/2007 | |
| CN | 103025337 | A | 4/2013 | |
| CN | 104254178 | A | 12/2014 | |
| CN | 104302039 | A | 1/2015 | |
| DE | 19725710 | | 1/1998 | |
| EP | 492117 | A2 | 7/1992 | |
| EP | 0657697 | | 6/1995 | |
| EP | 0 923 274 | | 6/1999 | |
| EP | 1271799 | A1 * | 1/2003 | H04B 3/54 |
| EP | 1313353 | | 5/2003 | |
| EP | 1701589 | | 9/2006 | |
| EP | 2073607 | | 6/2009 | |
| EP | 2273851 | | 1/2011 | |
| EP | 2501393 | A2 | 9/2012 | |
| GB | 2335334 | | 9/1999 | |
| GB | 2335334 | A1 * | 9/1999 | H04B 3/54 |
| JP | 57133685 | | 8/1982 | |
| JP | 6166564 | A | 4/1986 | |
| JP | 11162664 | | 6/1999 | |
| JP | 2003188415 | | 7/2003 | |
| JP | 2003317979 | | 11/2003 | |
| JP | 2004296205 | A | 10/2004 | |
| JP | 2005038754 | A | 2/2005 | |
| JP | 2005285528 | A | 10/2005 | |
| JP | 2007227155 | A | 9/2007 | |
| JP | 2008172999 | A | 7/2008 | |
| JP | 2008224136 | A | 9/2008 | |
| JP | 2009083590 | | 4/2009 | |
| JP | 2013517613 | A | 5/2013 | |
| KR | 2000006665 | | 2/2000 | |
| KR | 2006098345 | | 9/2006 | |
| KR | 20070053818 | | 5/2007 | |
| WO | WO-90/010238 | | 9/1990 | |
| WO | WO-99/000650 | | 1/1999 | |
| WO | WO-00/017728 | | 3/2000 | |
| WO | 2004/075606 | A1 | 9/2004 | |
| WO | 2006043232 | A1 | 4/2006 | |
| WO | WO-2006058418 | | 6/2006 | |
| WO | 2007/147573 | A1 | 12/2007 | |
| WO | 2008096249 | A2 | 8/2008 | |
| WO | WO2008096249 | A2 * | 8/2008 | H05B 33/08 |
| WO | WO-2009055821 | | 4/2009 | |
| WO | 2009064099 | A2 | 5/2009 | |
| WO | WO-2009079944 | | 7/2009 | |
| WO | WO-2005081591 | | 9/2009 | |
| WO | 2010/137002 | A1 | 12/2010 | |
| WO | WO-11/044040 | | 4/2011 | |
| WO | 2011/051859 | A1 | 5/2011 | |
| WO | WO-11/056242 | | 5/2011 | |
| WO | 2011/114250 | A1 | 9/2011 | |
| WO | 2011/137646 | A1 | 11/2011 | |
| WO | 2011/145009 | A1 | 11/2011 | |
| WO | 2012/007798 | A2 | 1/2012 | |
| WO | 2012087268 | A2 | 6/2012 | |
| WO | 2012162601 | A1 | 11/2012 | |
| WO | 2013090904 | A1 | 6/2013 | |

OTHER PUBLICATIONS

U.S. Appl. No. 12/948,589, filed Nov. 17, 2010, by Harrison et al.
U.S. Appl. No. 12/948,591, filed Nov. 17, 2010, by Harrison et al.
U.S. Appl. No. 13/234,343, filed Sep. 16, 2011, by Koski et al.
International Search Report issued for International Application No. PCT/2010/057060, dated Sep. 6, 2012 and maled Nov. 23, 2012.
International Search Report and Written Opinion dated Feb. 6, 2012 for International Application No. PCT/US2011/051883 (12 pages).
Extended Search Report issued for European Patent Application No. 10732010.3, dated Nov. 29, 2013, 7 pages.
International Application Serial No. PCT/US2010/057060, International Preliminary Report on Patentability dated Jan. 24, 2013, 8 pages.
International Application Serial No. PCT/US2012/039558, International Preliminary Report on Patentability dated Dec. 5, 2013, 7 pages.
International Application Serial No. PCT/US2012/039558, International Search Report and Written Opinion dated Sep. 24, 2012, 8 pages.
International Application Serial No. PCT/US2012/070126, International Search Report dated May 6, 2013, 3 pages.
Prendergast, Patrick, "Thermal Design Considerations for High Power LED Systems", Cypress Semiconductor Corp., Published in Planet Analog, Mar. 2007, pp. 1-8.
International Search Report and Written Opinion dated Aug. 13, 2010 for International Application No. PCT/US2010/020819 (8 pages).
International Preliminary Report on Patentability dated Jul. 28, 2011 for International Application No. PCT/US2010/020819 (7 pages).
Pham, Thai N, "Office Action Regarding U.S. Appl. No. 15/065,655", dated Jul. 18, 2016, p. 18, Published in: US.
He, Shi, "Chinese Office Action re Application No. 201410406262.8", dated Jan. 4, 2016, p. 26, Published in: CN.

(56) References Cited

OTHER PUBLICATIONS

Schneider, Laura, "Response to Office Action Regarding U.S. Appl. No. 15/065,655", dated Sep. 8, 2016, p. 10, Published in: US.
Xu, Shute Shu, "Response to Office Action Regarding CN Application No. 2014104058887", dated May 18, 2016, p. 7, Published in: CN.
Howell, Steven, "Australian Office Action re Application No. 2012258584", dated Feb. 18, 2015, p. 4, Published in: AU.
Howell, Steven, "Australian Office Action re Application No. 2012258584", dated May 20, 2014, p. 3, Published in: AU.
O'Malley, Andrew, "Canadian Office Action re Application No. 2835875", dated Mar. 19, 2015, p. 3, Published in: CA.
Yao, Yan, "Chinese Office Action re Application No. 2010800615881", dated Jun. 4, 2014, p. 4, Published in: CN.
Boudet, Joachim, "European Office Action re Application No. 10859616.4", dated Oct. 28, 2014, p. 4, Published in: EP.
Johnson, Christine, "Office Action re U.S. Appl. No. 12/948,591", dated Jul. 29, 2013, p. 31, Published in: US.
Johnson, Christine, "Office Action re U.S. Appl. No. 12/948,589", dated Nov. 21, 2013, p. 15, Published in: US.
Mishimagi, Hidehiro, "Japanese Office Action re Application No. 2012-549988", dated Jun. 22, 2015, p. 11, Published in: JP.
Mishimagi, Hidehiro, "Japanese Office Action re Application No. 2012549988", dated Oct. 2, 2014, p. 16, Published in: JP.
Pham, Thai, "Office Action re U.S. Appl. No. 14/177,673", dated Jan. 16, 2015, p. 56, Published in: US.
Johnson, Christine, "Office Action re U.S. Appl. No. 12/948,591", dated Jan. 17, 2013, p. 46, Published in: US.
Johnson, Christine, "Office Action re U.S. Appl. No. 12/948,589", dated Mar. 14, 2013, p. 47, Published in: US.
Pham. Thai, "Office Action re U.S. Appl. No. 12/683,393", dated Mar. 20, 2015, p. 9, Published in: US.
Johnson, Christine, "Office Action re U.S. Appl. No. 12/948,591", dated Apr. 3, 2014, p. 32, Published in: US.
Pham, Thai, "Office Action re U.S. Appl. No. 12/683,393", dated May 22, 2012, p. 43, Published in: US.
Pham, Thai, "Office Action re U.S. Appl. No. 13/718,366", dated Jul. 25, 2013, p. 78, Published in: US.
Johnson, Christine, "Office Action re U.S. Appl. No. 12/948,589", dated Oct. 30, 2014, p. 65, Published in: US.
Lindner, Nora, "International Preliminary Report on Patentability re Application No. PCTUS2011051883", dated Mar. 19, 2013, p. 8, Published in: SE.
Lindner, Nora, "International Preliminary Report on Patentability re Application No. PCTUS2012070126", dated Mar. 17, 2014, p. 7, Published in: SE.
Currie, Matthew T., "Response to Office Action re U.S. Appl. No. 14/177,673", dated Apr. 13, 2015, p. 10, Published in: US.
Russell, Steven J., "Response to Office Action Re U.S. Appl. No. 12/948,591", dated Apr. 17, 2013, p. 10, Published in: US.
Neugeboren, Craig, "Office Action re U.S. Appl. No. 12/259,929", dated Apr. 18, 2012, p. 16, Published in: US.
Currie, Matthew T., "Response to Office Action re U.S. Appl. No. 12/683,393", dated Jul. 11, 2012, p. 16, Published in: US.
Russell, Steven J., "Response to Office Action re U.S. Appl. No. 12/948,589", dated Aug. 13, 2013, p. 14, Published in: US.
Currie, Matthew T., "Response to Office Action re U.S. Appl. No. 13/718,366", dated Oct. 23, 2013, p. 14, Published in: US.
O'Malley, Andrew, "Office Action Regarding Patent Application No. 2,749,472", dated Jan. 18, 2017, p. 3, Published in: CA.
O'Malley, Andrew, "Office Action Regarding Patent Application No. 2,749,472", dated Feb. 29, 2016, p. 5, Published in: CA.
Pan, James, "Response to Office Action Regarding Application No. 2749472", dated Aug. 29, 2016, p. 54, Published in: CA.
Russell, Steven J., "Response to Office Action Regarding U.S. Appl. No. 12/948,589", dated Jan. 18, 2014, p. 22, Published in: US.
Russell, Steven J., "Response to Office Action Regarding U.S. Appl. No. 12/948,591", dated Oct. 29, 2013, p. 16, Published in: US.
D'Malley, Andrew, "Office Action Regarding Patent Application No. 2967422", dated Nov. 22, 2018, p. 3, Published in: CA.
Liu, Huanling, "Office Action Regarding CN Patent Application No. 201410405888.7", dated Jan. 7, 2016, p. 11, Published in: CN.
He, Shi, "Office Action Regarding Patent Application No. 201410406262.8", dated Aug. 1, 2016, pp. 19, Published in: CN.
Ferla, Monica, "Office Action Regarding Application No. 10859616.4", dated Sep. 16, 2015, p. 35, Published in: EP.
Boudet, Joachim, "Extended European Search Report Regarding Application No. 16151307.2", dated May 19, 2016, p. 7, Published in: EP.
Miyazaki, Koji, "Office Action Regarding JP Patent Application No. 2015-016411", dated Jan. 5, 2016, p. 6, Published in: JP.

* cited by examiner

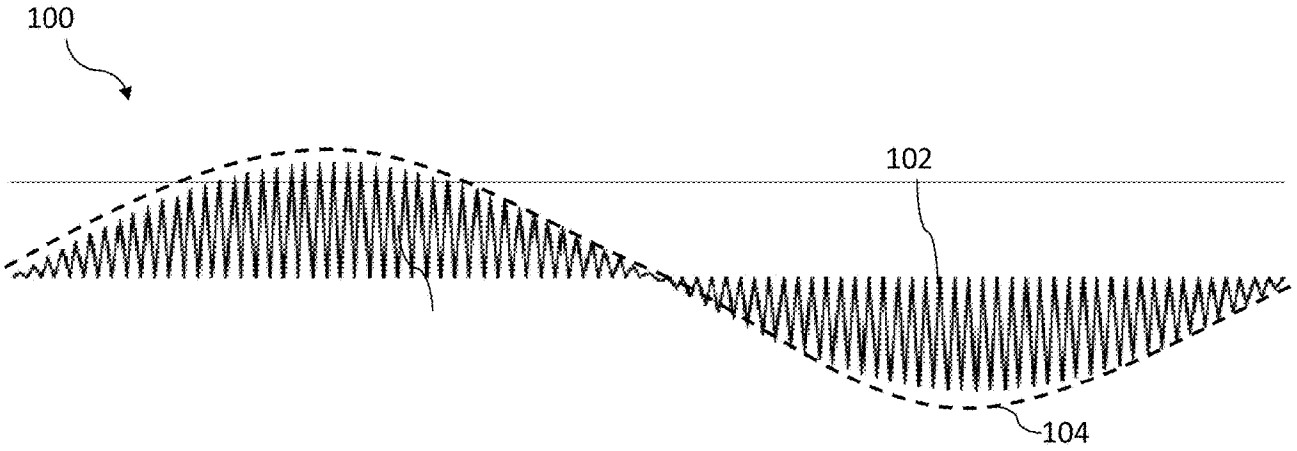
FIG. 1 – PRIOR ART
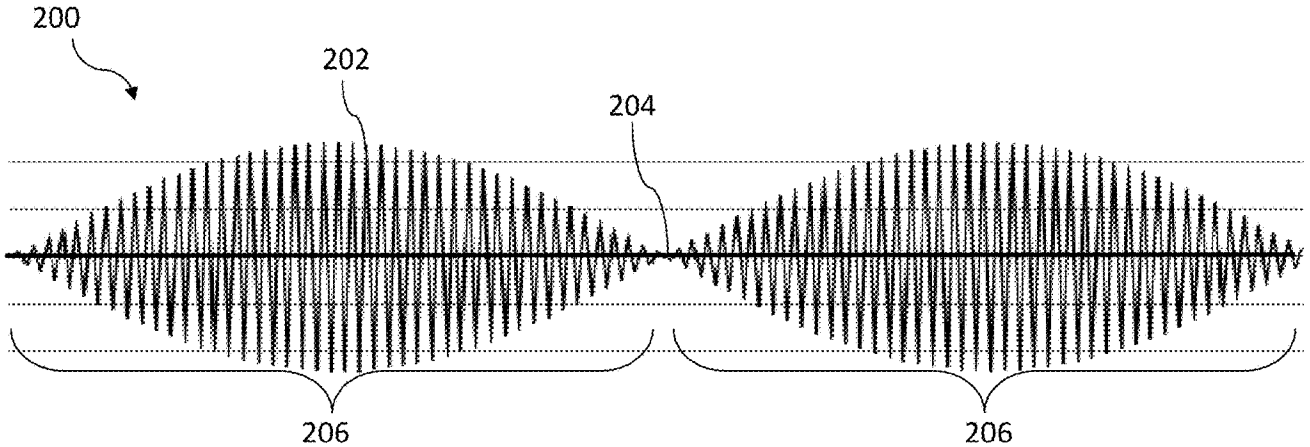
FIG. 2 – PRIOR ART

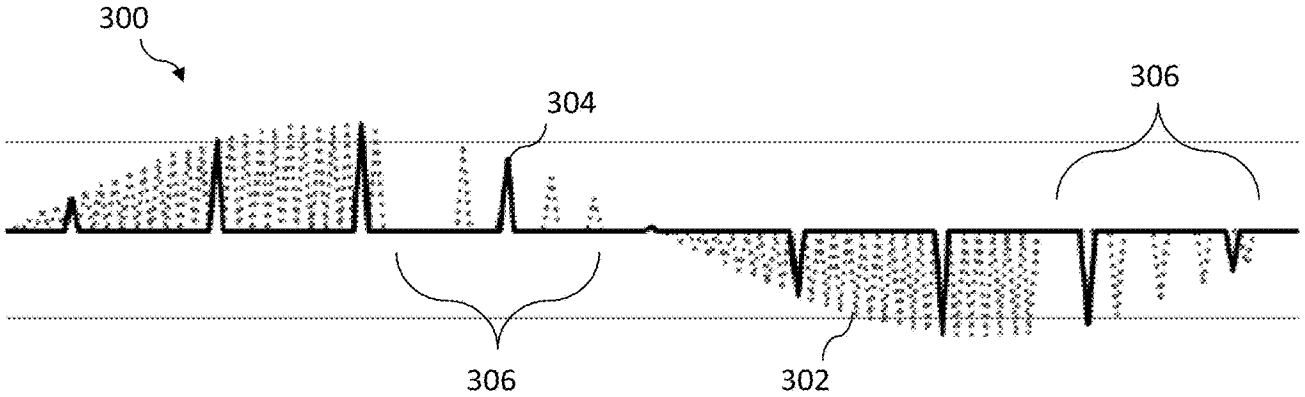
FIG. 3 – PRIOR ART
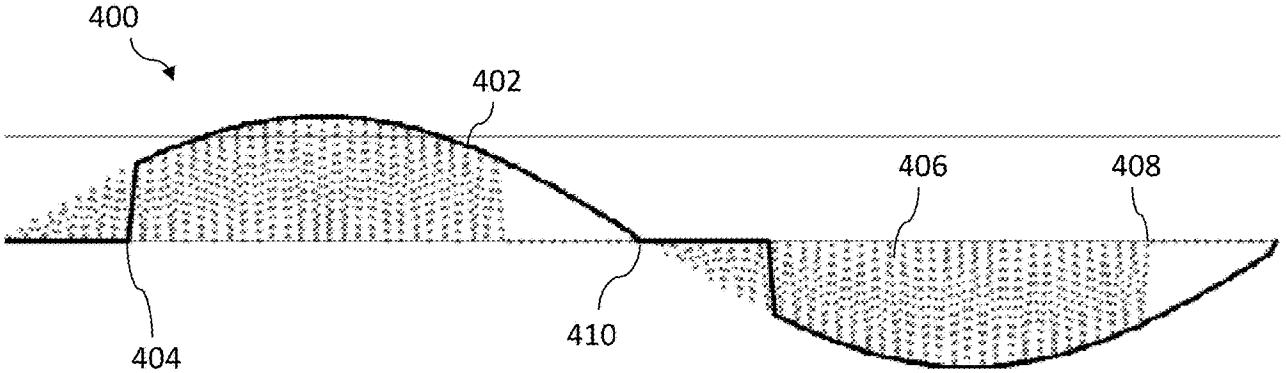
FIG. 4 – PRIOR ART

LED POWER-SUPPLY DETECTION AND CONTROL

CROSS-REFERENCE TO RELATED APPLICATIONS

This application claims priority to and the benefit of U.S. Provisional Patent Application Ser. No. 61/261,991, filed on Nov. 17, 2009, which is hereby incorporated herein by reference in its entirety.

TECHNICAL FIELD

Embodiments of the invention generally relate to LED light sources and, in particular, to powering LED light sources using different types of power supplies.

BACKGROUND

LED light sources (i.e., LED lamps or, more familiarly, LED "light bulbs") provide an energy-efficient alternative to traditional types of light sources, but typically require specialized circuitry to properly power the LED(s) within the light source. As used herein, the terms LED light sources, lamps, and/or bulbs refer to systems that include LED driver and support circuitry (the "LED module") as well as the actual LED(s). For LED light sources to gain wide acceptance in place of traditional light sources, their support circuitry must be compatible with as many types of existing lighting systems as possible. For example, incandescent bulbs may be connected directly to an AC mains voltage, halogen-light systems may use magnetic or electronic transformers to provide 12 or 24 VAC to a halogen bulb, and other light sources may be powered by a DC current or voltage. Furthermore, AC mains voltages may vary country-by-country (60 Hz in the United States, for example, and 50 Hz in Europe).

Current LED light sources are compatible with only a subset of the above types of lighting system configurations and, even when they are compatible, they may not provide a user experience similar to that of a traditional bulb. For example, an LED replacement bulb may not respond to a dimmer control in a manner similar to the response of a traditional bulb. One of the difficulties in designing, in particular, halogen-replacement LED light sources is compatibility with the two kinds of transformers (i.e., magnetic and electronic) that may have been originally used to power a halogen bulb. A magnetic transformer consists of a pair of coupled inductors that step an input voltage up or down based on the number of windings of each inductor, while an electronic transformer is a complex electrical circuit that produces a high-frequency (i.e., 100 kHz or greater) AC voltage that approximates the low-frequency (60 Hz) output of a magnetic transformer. FIG. 1 is a graph 100 of an output 102 of an electronic transformer; the envelope 104 of the output 102 approximates a low-frequency signal, such as one produced by a magnetic transformer. FIG. 2 is a graph 200 of another type of output 202 produced by an electronic transformer. In this example, the output 202 does not maintain consistent polarity relative to a virtual ground 204 within a half 60 Hz period 206. Thus, magnetic and electronic transformers behave differently, and a circuit designed to work with one may not work with the other.

For example, while magnetic transformers produce a regular AC waveform for any level of load, electronic transformers have a minimum load requirement under which a portion of their pulse-train output is either intermittent or entirely cut off. The graph 300 shown in FIG. 3 illustrates the output of an electronic transformer for a light load 302 and for no load 304. In each case, portions 306 of the outputs are clipped—these portions 306 are herein referred to as underload dead time ("ULDT"). LED modules may draw less power than permitted by transformers designed for halogen bulbs and, without further modification, may cause the transformer to operate in the ULDT regions 306.

To avoid this problem, some LED light sources use a "bleeder" circuit that draws additional power from the halogen-light transformer so that it does not engage in the ULDT behavior. With a bleeder, any clipping can be assumed to be caused by the dimmer, not by the ULDT. Because the bleeder circuit does not produce light, however, it merely wastes power, and may not be compatible with a low-power application. Indeed, LED light sources are preferred over conventional lights in part for their smaller power requirement, and the use of a bleeder circuit runs contrary to this advantage. In addition, if the LED light source is also to be used with a magnetic transformer, the bleeder circuit is no longer necessary yet still consumes power.

Dimmer circuits are another area of incompatibility between magnetic and electronic transformers. Dimmer circuits typically operate by a method known as phase dimming, in which a portion of a dimmer-input waveform is cut off to produce a clipped version of the waveform. The graph 400 shown in FIG. 4 illustrates a result 402 of dimming an output of a magnetic transformer by cutting off a leading-edge point 404 and a result 406 dimming an output of an electronic transformer by cutting off a trailing-edge point 408. The duration (i.e., duty cycle) of the clipping corresponds to the level of dimming desired—more clipping produces a dimmer light. Accordingly, unlike the dimmer circuit for an incandescent light, where the clipped input waveform directly supplies power to the lamp (with the degree of clipping determining the amount of power supplied and, hence, the lamp's brightness), in an LED system the received input waveform may be used to power a regulated supply that, in turn, powers the LED. Thus, the input waveform may be analyzed to infer the dimmer setting and, based thereon, the output of the regulated LED power supply is adjusted to provide the intended dimming level.

One implementation of a magnetic-transformer dimmer circuit measures the amount of time the input waveform is at or near the zero crossing 410 and produces a control signal that is a proportional function of this time. The control signal, in turn, adjusts the power provided to the LED. Because the output of a magnetic transformer (such as the output 402) is at or near a zero crossing 410 only at the beginning or end of a half-cycle, this type of dimmer circuit produces the intended result. The output of electronic transformers (such as the output 406), however, approaches zero many times during the non-clipped portion of the waveform due to its high-frequency pulse-train behavior. Zero-crossing detection schemes, therefore, must filter out these short-duration zero crossings while still be sensitive enough to react to small changes in the duration of the intended dimming level.

Because electronic transformers typically employ a ULDT-prevention circuit (e.g., a bleeder circuit), however, a simple zero-crossing-based dimming-detection method is not workable. If a dimmer circuit clips parts of the input waveform, the LED module reacts by reducing the power to the LEDs. In response, the electronic transformer reacts to the lighter load by clipping even more of the AC waveform, and the LED module interprets that as a request for further dimming and reduces LED power even more. The ULDT of the transformer then clips even more, and this cycle repeats until the light turns off entirely.

The use of a dimmer with an electronic transformer may cause yet another problem due to the ULDT behavior of the transformer. In one situation, the dimmer is adjusted to reduce the brightness of the LED light. The constant-current driver, in response, decreases the current drawn by the LED light, thereby decreasing the load of the transformer. As the load decreases below a certain required minimum value, the transformer engages in the ULDT behavior, decreasing the power supplied to the LED source. In response, the LED driver decreases the brightness of the light again, causing the transformer's load to decrease further; that causes the transformer to decrease its power output even more. This cycle eventually results in completely turning off the LED light.

Furthermore, electronic transformers are designed to power a resistive load, such as a halogen bulb, in a manner roughly equivalent to a magnetic transformer. LED light sources, however, present smaller, nonlinear loads to an electronic transformer and may lead to very different behavior. The brightness of a halogen bulb is roughly proportional to its input power; the nonlinear nature of LEDs, however, means that their brightness may not be proportional to their input power. Generally, LED light sources require constant-current drivers to provide a linear response. When a dimmer designed for a halogen bulb is used with an electronic transformer to power an LED source, therefore, the response may not be the linear, gradual response expected, but rather a nonlinear and/or abrupt brightening or darkening.

In addition, existing analog methods for thermal management of an LED involve to either a linear response or the response characteristics of a thermistor. While an analog thermal-management circuit may be configured to never exceed manufacturing limits, the linear/thermistor response is not likely to produce an ideal response (e.g., the LED may not always be as bright as it could otherwise be). Furthermore, prior-art techniques for merging thermal and dimming level parameters perform summation or multiplication; a drawback of these approaches is that an end user could dim a hot lamp but, as the lamp cools in response to the dimming, the thermal limit of the lamp increases and the summation or multiplication of the dimming level and the thermal limit results in the light growing brighter than the desired level.

Therefore, there is a need for a power-efficient, supply-agnostic LED light source capable of replacing different types of existing bulbs, regardless of the type of transformer and/or dimmer used to power and/or control the existing bulb.

SUMMARY

In general, embodiments of the current invention include systems and methods for controlling an LED driver circuit so that it operates regardless of the type of power source used. By analyzing the type of the power supply driving the LED, a control circuit is able to modify the behavior of the LED driver circuit to interface with the detected type of power supply. For example, a transformer output waveform may be analyzed to detect its frequency components. The existence of high-frequency components suggests, for example, that the transformer is electronic, and the lack of high-frequency components indicates the presence a magnetic transformer.

Accordingly, in one aspect, a circuit for modifying a behavior of an LED driver in accordance with a detected power supply type includes an analyzer and a generator. The analyzer determines the type of the power supply based at least in part on a power signal received from the power supply. The generator generates a control signal, based at least in part on the determined type of the power supply, for controlling the behavior of the LED driver.

In various embodiments, the type of the power supply includes a DC power supply, a magnetic-transformer power supply, or an electronic-transformer power supply and/or a manufacturer or a model of the power supply. The analyzer may include digital logic. The behavior of the LED driver may include a voltage or current output level. An input/output port may communicate with at least one of the analyzer and the generator. The analyzer may include a frequency analyzer for determining a frequency of the power signal. A dimmer control circuit may dim an output of the LED driver by modifying the control signal in accordance with a dimmer setting.

A bleeder control circuit may maintain the power supply in an operating region by selectively engaging a bleeder circuit to increase a load of the power supply. A thermal control circuit may reduce an output of the LED driver by modifying the control signal in accordance with an over-temperature condition. The generated control signal may include a voltage control signal, a current control signal, or a pulse-width-modulated control signal.

In general, in another aspect, a method modifies a behavior of an LED driver circuit in accordance with a detected a power supply type. The type of the power supply is determined based at least in part on analyzing a power signal received from the power supply. The behavior of the LED driver is controlled based at least in part on the determined type of power supply.

In various embodiments, determining the type of the power supply includes detecting a frequency of the power supply signal. The frequency may be detected in less than one second or in less than one-tenth of a second. Modifying the behavior may include modifying an output current or voltage level. A load of the power supply may be detected, and determining the type of the power supply may further include pairing the detected frequency with the detected load. The load of the power supply may be changed using the control signal and measuring the frequency of the power supply signal at the changed load. A country or a region supplying AC mains power to the power supply may be detected. Generating the control signal may include generating at least one of a voltage control signal, current control signal, or a pulse-width-modulated control signal.

These and other objects, along with advantages and features of the present invention herein disclosed, will become more apparent through reference to the following description, the accompanying drawings, and the claims. Furthermore, it is to be understood that the features of the various embodiments described herein are not mutually exclusive and may exist in various combinations and permutations.

BRIEF DESCRIPTION OF THE DRAWINGS

In the drawings, like reference characters generally refer to the same parts throughout the different views. In the following description, various embodiments of the present invention are described with reference to the following drawings, in which:

FIG. 1 is a graph of an output of an electronic transformer;

FIG. 2 is a graph of another output of an electronic transformer;

FIG. 3 is a graph of an output of an electronic transformer under different load conditions;

FIG. 4 is a graph of a result of dimming the outputs of transformers;

DETAILED DESCRIPTION

Figure 5:
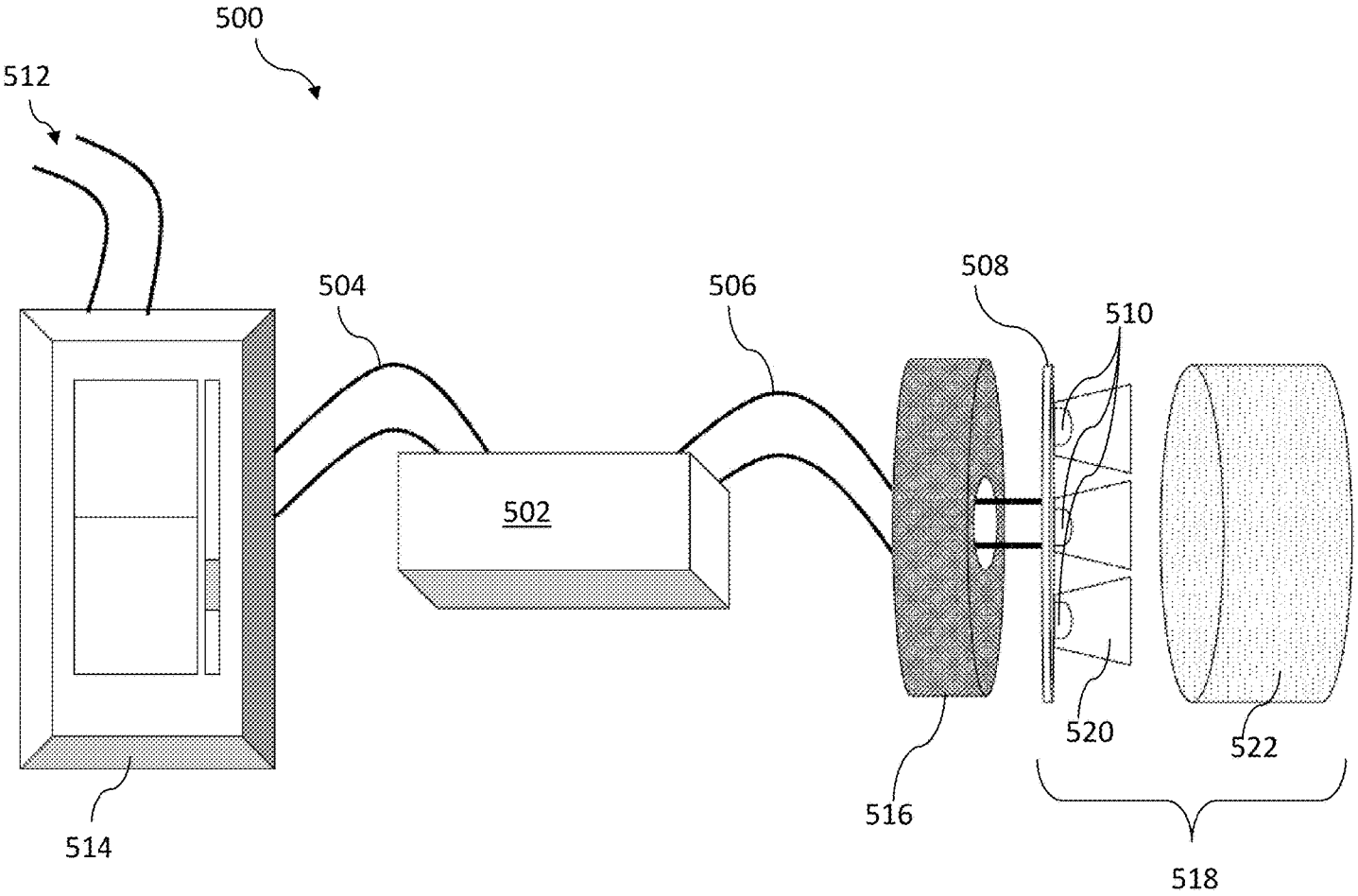
FIG. 5 is a block diagram of an LED lighting circuit in accordance with embodiments of the invention.

FIG. 5 illustrates a block diagram 500 of various embodiments of the present invention. A transformer 502 receives a transformer input signal 504 and provides a transformed output signal 506. The transformer 502 may be a magnetic transformer or an electronic transformer, and the output signal 506 may be a low-frequency (i.e. less than or equal to approximately 120 Hz) AC signal or a high-frequency (e.g., greater than approximately 120 Hz) AC signal, respectively. The transformer 502 may be, for example, a 5:1 or a 10:1 transformer providing a stepped-down 60 Hz output signal 506 (or output signal envelope, if the transformer 502 is an electronic transformer). The transformer output signal 506 is received by an LED module 508, which converts the transformer output signal 506 into a signal suitable for powering one or more LEDs 510. In accordance with embodiments of the invention, and as explained in more detail below, the LED module 508 detects the type of the transformer 502 and alters its behavior accordingly to provide a consistent power supply to the LEDs 510.

In various embodiments, the transformer input signal 504 may be an AC mains signal 512, or it may be received from a dimmer circuit 514. The dimmer circuit may be, for example, a wall dimmer circuit or a lamp-mounted dimmer circuit. A conventional heat sink 516 may be used to cool portions of the LED module 508. The LED module 508 and LEDs 510 may be part of an LED assembly (also known as an LED lamp or LED "bulb") 518, which may include aesthetic and/or functional elements such as lenses 520 and a cover 522.

The LED module 508 may include a rigid member suitable for mounting the LEDs 510, lenses 520, and/or cover 520. The rigid member may be (or include) a printed-circuit board, upon which one or more circuit components may be mounted. The circuit components may include passive components (e.g., capacitors, resistors, inductors, fuses, and the like), basic semiconductor components (e.g., diodes and transistors), and/or integrated-circuit chips (e.g., analog, digital, or mixed-signal chips, processors, microcontrollers, application-specific integrated circuits, field-programmable gate arrays, etc.). The circuit components included in the LED module 508 combine to adapt the transformer output signal 506 into a signal suitable for lighting the LEDs 520.

Figure 6:
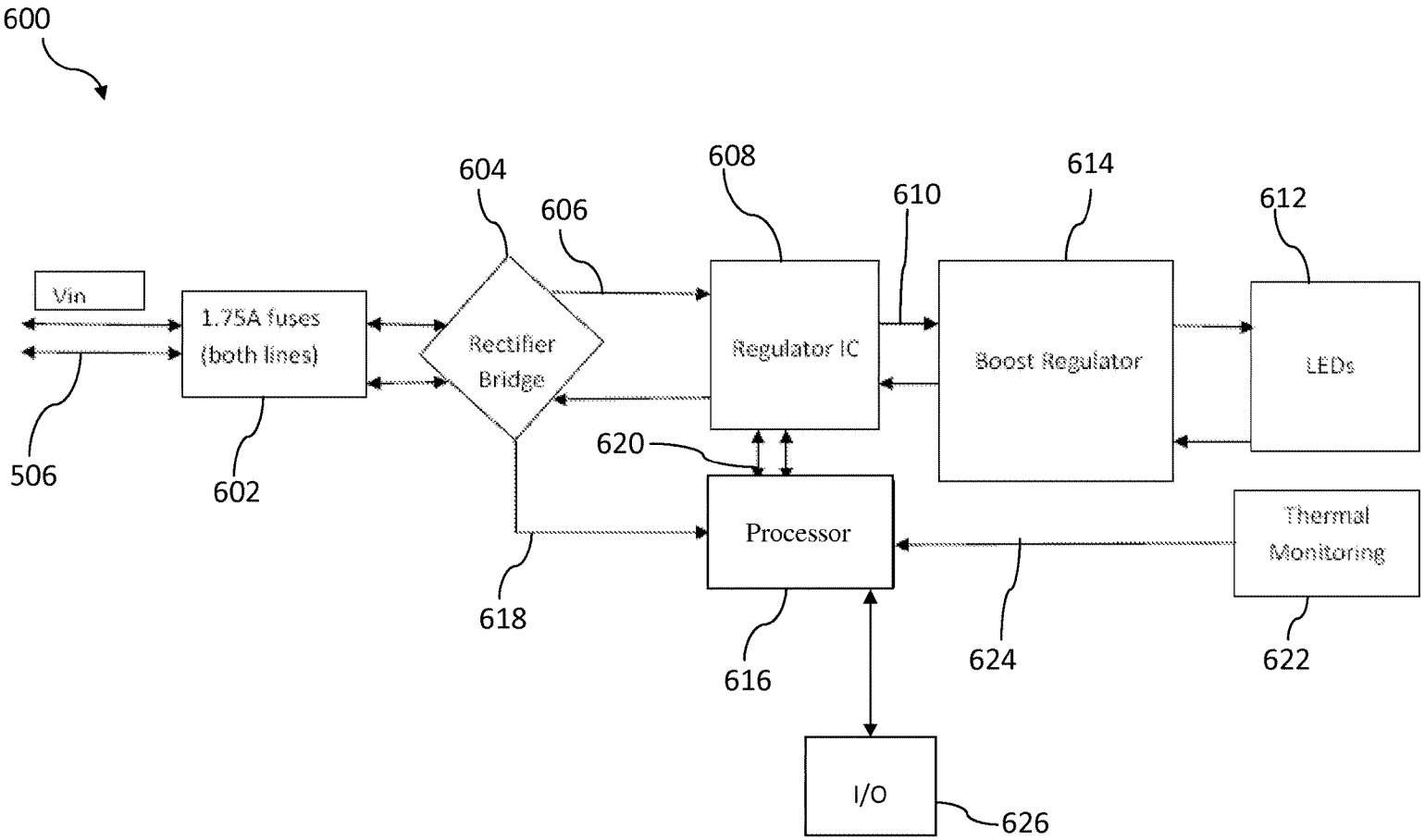
FIG. 6 is a block diagram of an LED module circuit in accordance with embodiments of the invention.

A block diagram of one such LED module circuit 600 is illustrated in FIG. 6. The transformer output signal 506 is received as an input signal $V_{in}$. One or more fuses 602 may be used to protect the circuitry of the LED module 600 from over-voltage or over-current conditions in the input signal $V_{in}$. One fuse may be used on one polarity of the input signal $V_{in}$, or two fuses may be used (one for each polarity), as shown in the figure. In one embodiment, the fuses are 1.75-amp fuses.

A rectifier bridge 604 is used to rectify the input signal $V_{in}$. The rectifier bridge 604 may be, for example, a full-wave or half-wave rectifier, and may use diodes or other one-way devices to rectify the input signal $V_{in}$. The current invention is not limited to any particular type of rectifier bridge, however, or any type of components used therein. As one of skill in the art will understand, any bridge 604 capable of modifying the AC-like input signal $V_{in}$ in to a more DC-like output signal 606 is compatible with the current invention.

A regulator IC 608 receives the rectifier output 606 and converts it into a regulated output 610. In one embodiment, the regulated output 610 is a constant-current signal calibrated to drive the LEDs 612 at a current level within their tolerance limits. In other embodiments, the regulated output 610 is a regulated voltage supply, and may be used with a ballast (e.g., a resistive, reactive, and/or electronic ballast) to limit the current through the LEDs 612.

A DC-to-DC converter may be used to modify the regulated output 610. In one embodiment, as shown in FIG. 6, a boost regulator 614 is used to increase the voltage or current level of the regulated output 610. In other embodiments, a buck converter or boost-buck converter may be used. The DC-to-DC converter 614 may be incorporated into the regulator IC 608 or may be a separate component; in some embodiments, no DC-to-DC converter 614 may be present at all.

A processor 616 is used, in accordance with embodiments of the current invention, to modify the behavior of the regulator IC 608 based at least in part on a received signal 618 from the bridge 604. In other embodiments, the signal 618 is connected directly to the input voltage $V_{in}$ of the LED module 600. The processor 616 may be a microprocessor, microcontroller, application-specific integrated circuit, field-programmable grid array, or any other type of digital-logic or mixed-signal circuit. The processor 616 may be selected to be low-cost, low-power, for its durability, and/or for its longevity. An input/output link 620 allows the processor 616 to send and receive control and/or data signals to and/or from the regulator IC 608. As described in more detail below, a thermal monitoring module 622 may be used to monitor a thermal property of one or more LEDs 612. The processor 616 may also be used to track the runtime of the LEDs 612 or other components and to track a current or historical power level applied to the LEDs 612 or other components. In one embodiment, the processor 616 may be used to predict the lifetime of the LEDs 612 given such inputs as runtime, power level, and estimated lifetime of the LEDs 612. This and other information and/or commands may be accessed via an input/output port 626, which may be a serial port, parallel port, JTAG port, network interface, or any other input/output port architecture as known in the art.

Figure 7:
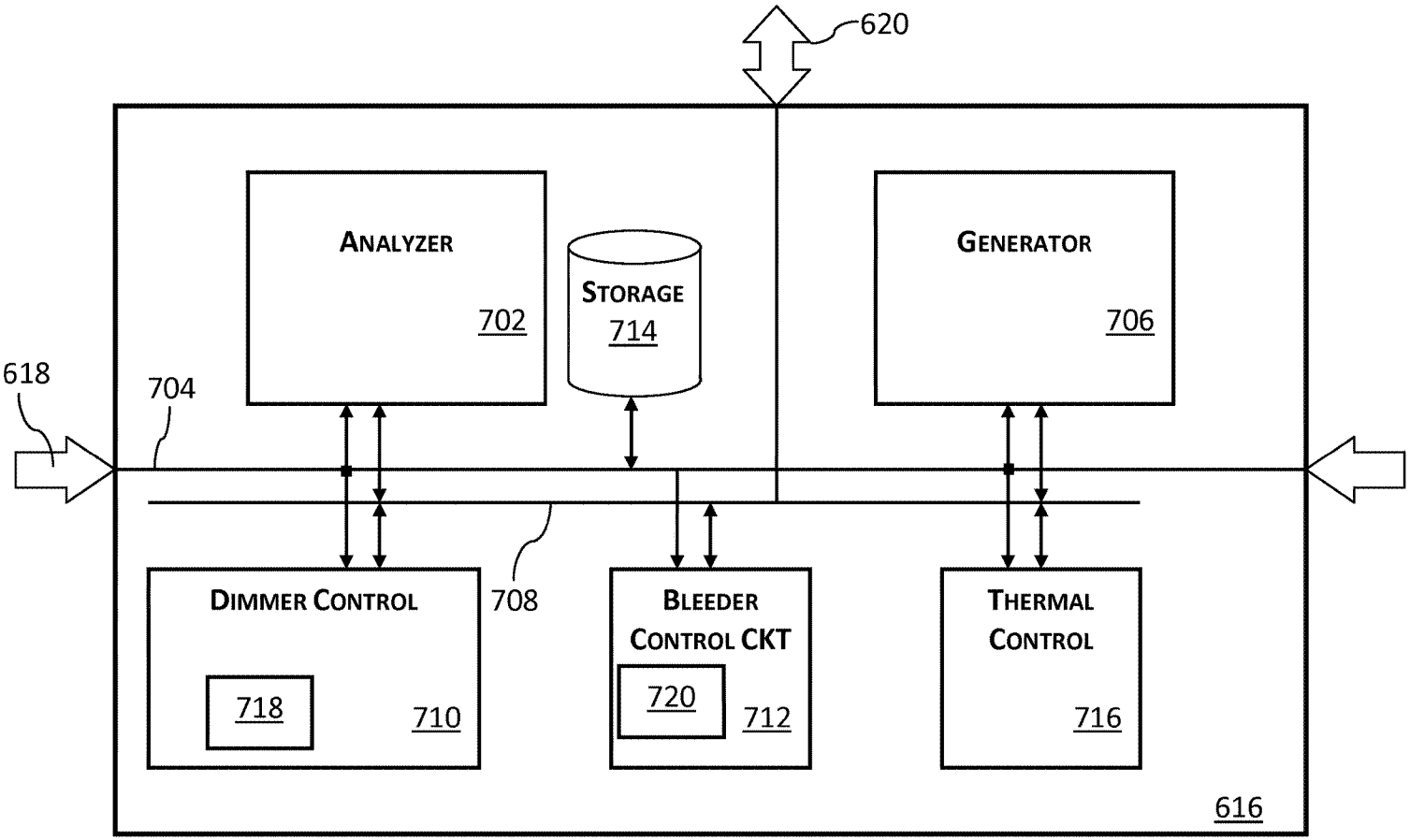
FIG. 7 is a block diagram of a processor for controlling an LED module in accordance with embodiments of the invention.

The operation of the processor 616 is described in greater detail with reference to FIG. 7. An analyzer 702 receives the signal 618 via an input bus 704. When the system powers on and the input signal 618 becomes non-zero, the analyzer 702 begins analyzing the signal 618. In one embodiment, the analyzer 702 examines one or more frequency components of the input signal 618. If no significant frequency components exist (i.e., the power level of any frequency components is less than approximately 5% of a total power level of the signal), the analyzer determines that the input signal 618 is a DC signal. If one or more frequency components exist and are less than or equal to approximately 120 Hz, the analyzer determines that the input signal 618 is derived from the output of a magnetic transformer. For example, a magnetic transformer supplied by an AC mains voltage outputs a signal having a frequency of 60 Hz; the processor 616 receives the signal and the analyzer detects that its frequency is less than 120 Hz and concludes that the signal was generated by a magnetic transformer. If one or more frequency components of the input signal 618 are greater than approximately 120 Hz, the analyzer 702 concludes that the signal 618 was generated by an electronic transformer. In this case, the frequency of the signal 618 may be significantly higher than 120 Hz (e.g., 50 or 100 kHz).

The analyzer 702 may employ any frequency detection scheme known in the art to detect the frequency of the input signal 618. For example, the frequency detector may be an analog-based circuit, such as a phase-frequency detector, or it may be a digital circuit that samples the input signal 618 and processes the sampled digital data to determine the frequency. In one embodiment, the analyzer 702 detects a load condition presented by the regulator IC 608. For example, the analyzer 702 may receive a signal representing a current operating point of the regulator IC 608 and determine its input load; alternatively, the regulator IC 608 may directly report its input load. In another embodiment, the analyzer 702 may send a control signal to the regulator IC 608 requesting that it configure itself to present a particular input load. In one embodiment, the processor 616 may use a dimming control signal, as explained further below, to vary the load.

The analyzer 702 may correlate a determined input load with the frequency detected at that load to derive further information about the transformer 502. For example, the manufacturer and/or model of the transformer 502, and in particular an electronic transformer, may be detected from this information. The analyzer 702 may include a storage device 714, which may be a read-only memory, flash memory, look-up table, or any other storage device, and contain data on devices, frequencies, and loads. Addressing the storage device with the one or more load-frequency data points may result in a determination of the type of the transformer 502. The storage device 714 may contain discrete values or expected ranges for the data stored therein; in one embodiment, detected load and frequency information may be matched to stored values or ranges; in another embodiment, the closest matching stored values or ranges are selected.

The analyzer 702 may also determine, from the input signal 618, different AC mains standards used in different countries or regions. For example, the United States uses an AC mains having a frequency of 60 Hz, while Europe has an AC mains of 50 Hz. The analyzer 702 may report this result to the generator 704, which in turn generates an appropriate control signal for the regulator IC 608. The regulator IC 608 may include a circuit for adjusting its behavior based on a detected country or region. Thus, the LED module 600 may be country- or region-agnostic.

The analysis carried out by the analyzer 702 make take place upon system power-up, and duration of the analysis may be less than one second (e.g., enough time to observe at least 60 cycles of standard AC mains input voltage). In other embodiments, the duration of the analysis is less than one-tenth of a second (e.g., enough time to observe at least five cycles of AC mains input voltage). This span of time is short enough to be imperceptible, or nearly imperceptible, to a user. The analysis may also be carried out at other times during the operation of the LED module; for example, when the input supply voltage or frequency changes by a given threshold, or after a given amount of time has elapsed.

Once the type of power supply/transformer is determined, a generator circuit 706 generates a control signal in accordance with the detected type of transformer and sends the control signal to the regulator IC 608, via an input/output bus 708, through the input/output link 620. The regulator IC 608 may be capable of operating in a first mode that accepts a DC input voltage $V_{in}$, a second mode that accepts a low-frequency (≤120 Hz) input voltage $V_{in}$, and a third mode that accepts a high-frequency (>120 Hz) input voltage $V_{in}$. The generator circuit 706, based on the determination of the analyzer 702, instructs the regulator IC 608 to enter the first, second, or third mode. Thus, the LED module 600 is compatible with a wide variety of input voltages and transformer types.

The processor 616 may also include a dimmer control circuit 710, a bleeder control circuit 712, and/or a thermal control circuit 716. The operation of these circuits is explained in greater detail below.

Dimmer Control

The analyzer 702 and generator 706 may modify their control of the regulator IC 608 based on the absence or presence of a dimmer and, if a dimmer is present, an amount of dimming. A dimmer present in the upstream circuits may be detected by observing the input voltage 618 for, e.g., clipping, as discussed above with reference to FIG. 4. Typically, a dimmer designed to work with a magnetic transformer clips the leading edges of an input signal, and a dimmer designed to work with an electronic transformer clips the trailing edges of an input signal. The analyzer 702 may detect leading- or trailing-edge dimming on signals output by either type of transformer, however, by first detecting the type of transformer, as described above, and examining both the leading and trailing edges of the input signal.

Once the presence and/or type of dimming have been detected, the generator 706 and/or a dimmer control circuit 710 generate a control signal for the regulator IC 608 based on the detected dimming. The dimmer circuit 710 may include a duty-cycle estimator 718 for estimating a duty cycle of the input signal 618. The duty-cycle estimator may include any method of duty cycle estimation known in the art; in one embodiment, the duty-cycle estimator includes a zero-crossing detector for detecting zero crossings of the input signal 618 and deriving the duty cycle therefrom. As discussed above, the input signal 618 may include high-frequency components if it is generated by an electronic transformer; in this case, a filter may be used to remove the high-frequency zero crossings. For example, the filter may remove any consecutive crossings that occur during a time period smaller than a predetermined threshold (e.g., less than one millisecond). The filter may be an analog filter or may be implemented in digital logic in the dimmer control circuit 710.

In one embodiment, the dimmer control circuit 710 derives a level of intended dimming from the input voltage 618 and translates the intended dimming level to the output control signal 620. The amount of dimming in the output control signal 620 may vary depending on the type of transformer used to power the LED module 600.

For example, if a magnetic transformer 502 is used, the amount of clipping detected in the input signal 618 (i.e., the duty cycle of the signal) may vary from no clipping (i.e., approximately 100% duty cycle) to full clipping (i.e., approximately 0% duty cycle). An electronic transformer 502, on the other hand, requires a minimum amount of load to avoid the under-load dead time condition discussed above, and so may not support a lower dimming range near 0% duty cycle. In addition, some dimmer circuits (e.g., a 10%-90% dimmer circuit) consume power and thus prevent downstream circuits from receiving the full power available to the dimmer.

In one embodiment, the dimmer control circuit 710 determines a maximum setting of the upstream dimmer 514 (i.e., a setting that causes the least amount of dimming). The maximum dimmer setting may be determined by direct measurement of the input signal 618. For example, the signal 618 may be observed for a period of time and the maximum dimmer setting may equal the maximum observed voltage, current, or duty cycle of the input signal 618. In one embodiment, the input signal 618 is continually monitored, and if it achieves a power level higher than the current maximum dimmer level, the maximum dimmer level is updated with the newly observed level of the input signal 618.

Alternatively or in addition, the maximum setting of the upstream dimmer 514 may be derived based on the detected type of the upstream transformer 502. In one embodiment, magnetic and electronic transformers 502 have similar maximum dimmer settings. In other embodiments, an electronic transformer 502 has a lower maximum dimmer setting than a magnetic transformer 502.

Similarly, the dimmer control circuit 710 determines a minimum setting of the upstream dimmer 514 (i.e., a setting that causes the most amount of dimming). Like the maximum dimmer setting, the minimum setting may be derived from the detected type of the transformer 514 and/or may be directly observed by monitoring the input signal 618. The analyzer 702 and/or dimmer control circuit 710 may determine the manufacturer and model of the electronic transformer 514, as described above, by observing a frequency of the input signal 618 under one or more load conditions, and may base the minimum dimmer setting at least in part on the detected manufacturer and model. For example, a minimum load value for a given model of transformer may be known, and the dimmer control circuit 710 may base the minimum dimmer setting on the minimum load value.

Once the full range of dimmer settings of the input signal 618 is derived or detected, the available range of dimmer input values is mapped or translated into a range of control values for the regulator IC 608. In one embodiment, the dimmer control circuit 710 selects control values to provide a user with the greatest range of dimming settings. For example, if a 10%-90% dimmer is used, the range of values for the input signal 618 never approaches 0% or 100%, and thus, in other dimmer control circuits, the LEDs 612 would never be fully on or fully off. In the present invention, however, the dimmer control circuit 710 recognizes the 90% value of the input signal 618 as the maximum dimmer setting and outputs a control signal to the regulator IC 608 instructing it to power the LEDs 612 to full brightness. Similarly, the dimmer control circuit 710 translates the 10% minimum value of the input signal 618 to a value producing fully-off LEDs 612. In other words, in general, the dimmer control circuit 710 maps an available range of dimming of the input signal 618 (in this example, 10%-90%) onto a full 0%-100% output dimming range for controlling the regulator IC 608.

In one embodiment, as the upstream dimmer 514 is adjusted to a point somewhere between its minimum and maximum values, the dimmer control circuit 710 varies the control signal 620 to the regulator IC 608 proportionately. In other embodiments, the dimmer control circuit 710 may vary the control signal 620 linearly or logarithmically, or according to some other function dictated by the behavior of the overall circuit, as the upstream dimmer 514 is adjusted. Thus, the dimmer control circuit 710 may remove any inconsistencies or nonlinearities in the control of the upstream dimmer 514. In addition, as discussed above, the dimmer control circuit 710 may adjust the control signal 620 to avoid flickering of the LEDs 612 due to an under-load dead time condition. In one embodiment, the dimmer control circuit 710 may minimize or eliminate flickering, yet still allow the dimmer 514 to completely shut off the LEDs 612, by transitioning the LEDs quickly from their lowest non-flickering state to an off state as the dimmer 514 is fully engaged.

The generator 706 and/or dimmer control circuit 710 may output any type of control signal appropriate for the regulator IC 608. For example, the regulator IC may accept a voltage control signal, a current control signal, and/or a pulse-width modulation control signal. In one embodiment, the generator 706 sends, over the bus 620, a voltage, current, and/or pulse-width modulated signal that is directly mixed or used with the output signal 610 of the regulator IC 608. In other embodiments, the generator 706 outputs digital or analog control signals appropriate for the type of control (e.g., current, voltage, or pulse-width modulation), and the regulator IC 608 modifies its behavior in accordance with the control signals. The regulator IC 608 may implement dimming by reducing a current or voltage to the LEDs 612, within the tolerances of operation for the LEDs 612, and/or by changing a duty cycle of the signal powering the LEDs 612 using, for example, pulse-width modulation.

In computing and generating the control signal 620 for the regulator IC 608, the generator 706 and/or dimmer control circuit 710 may also take into account a consistent end-user experience. For example, magnetic and electronic dimming setups produce different duty cycles at the top and bottom of the dimming ranges, so a proportionate level of dimming may be computed differently for each setup. Thus, for example, if a setting of the dimmer 514 produces 50% dimming when using a magnetic transformer 502, that same setting produces 50% dimming when using an electronic transformer 502.

Bleeder Control

As described above, a bleeder circuit may be used to prevent an electronic transformer from falling into an ULDT condition. But, as further described above, bleeder circuits may be inefficient when used with an electronic transformer and both inefficient and unnecessary when used with a magnetic transformer. In embodiments of the current invention, however, once the analyzer 702 has determined the type of transformer 502 attached, a bleeder control circuit 712 controls when and if the bleeder circuit draws power. For example, for DC supplies and/or magnetic transformers, the bleeder is not turned on and therefore does not consume power. For electronic transformers, while a bleeder may sometimes be necessary, it may not be needed to run every cycle.

The bleeder may be needed during a cycle only when the processor 616 is trying to determine the amount of phase clipping produced by a dimmer 514. For example, a user may change a setting on the dimmer 514 so that the LEDs 612 become dimmer, and as a result the electronic transformer may be at risk for entering an ULDT condition. A phase-clip estimator 720 and/or the analyzer 702 may detect some of the clipping caused by the dimmer 514, but some of the clipping may be caused by ULDT; the phase-clip estimator 720 and/or analyzer 702 may not be able to initially tell one from the other. Thus, in one embodiment, when the analyzer 702 detects a change in a clipping level of the input signal 618, but before the generator 706 makes a corresponding change in the control signal 620, the bleeder control circuit 712 engages the bleeder. While the bleeder is engaged, any changes in the clipping level of the input signal 618 are a result only of action on the dimmer 514, and the analyzer 702 and/or dimmer control circuit 710 react accordingly. The delay caused by engaging the bleeder may last only a few cycles of the input signal 618, and thus the lag between changing a setting of the dimmer 514 and detecting a corresponding change in the brightness of the LEDs 612 is not perceived by the user.

In one embodiment, the phase-clip estimator 720 monitors preceding cycles of the input signal 618 and predict at what point in the cycle ULDT-based clipping would start (if no bleeder were engaged). For example, referring back to FIG. 3, ULDT-based clipping 306 for a light load 302 may occur only in the latter half of a cycle; during the rest of the cycle, the bleeder is engaged and drawing power, but is not required. Thus, the processor 616 may engage the bleeder load during only those times it is needed—slightly before (e.g., approximately 100 μs before) the clipping begins and shortly after (e.g., approximately 100 microseconds after) the clipping ends.

Thus, depending on the amount of ULDT-based clipping, the bleeder may draw current for only a few hundred microseconds per cycle, which corresponds to a duty cycle of less than 0.5%. In this embodiment, a bleeder designed to draw several watts incurs an average load of only a few tens of milliwatts. Therefore, selectively using the bleeder allows for highly accurate assessment of the desired dimming level with almost no power penalty.

In one embodiment, the bleeder control circuit 712 engages the bleeder whenever the electronic transformer 502 approaches an ULDT condition and thus prevents any distortion of the transformer output signal 506 caused thereby. In another embodiment, the bleeder control circuit 712 engages the bleeder circuit less frequently, thereby saving further power. In this embodiment, while the bleeder control circuit 712 prevents premature cutoff of the electronic transformer 502, its less-frequent engaging of the bleeder circuit allows temporary transient effects (e.g., "clicks") to appear on the output 506 of the transformer 502. The analyzer 702, however, may detect and filter out these clicks by instructing the generator 706 not to respond to them.

Thermal Control

The processor 616, having power control over the regulator IC 608, may perform thermal management of the LEDs 612. LED lifetime and lumen maintenance is linked to the temperature and power at which the LEDs 612 are operated; proper thermal management of the LEDs 612 may thus extend the life, and maintain the brightness, of the LEDs 612. In one embodiment, the processor 616 accepts an input 624 from a temperature sensor 622. The storage device 714 may contain maintenance data (e.g., lumen maintenance data) for the LEDs 612, and a thermal control circuit 716 may receive the temperature sensor input 624 and access maintenance data corresponding to a current thermal operating point of the LEDs 612. The thermal control circuit 716 may then calculate the safest operating point for the brightest LEDs 612 and instruct the generator 706 to increase or decrease the LED control signal accordingly.

The thermal control circuit 716 may also be used in conjunction with the dimmer control circuit 710. A desired dimming level may be merged with thermal management requirements, producing a single brightness-level setting. In one embodiment, the two parameters are computed independently (in the digital domain by, e.g., the thermal control circuit 716 and/or the dimmer control circuit 710) and only the lesser of the two is used to set the brightness level. Thus, embodiments of the current invention avoid the case in which a user dims a hot lamp—i.e., the lamp brightness is affected by both thermal limiting and by the dimmer—later to find that, as the lamp cools, the brightness level increases. In one embodiment, the thermal control circuit 716 "normalizes" 100% brightness to the value defined by the sensed temperature and instructs the dimmer control circuit 710 to dim from that standard.

Figure 8:
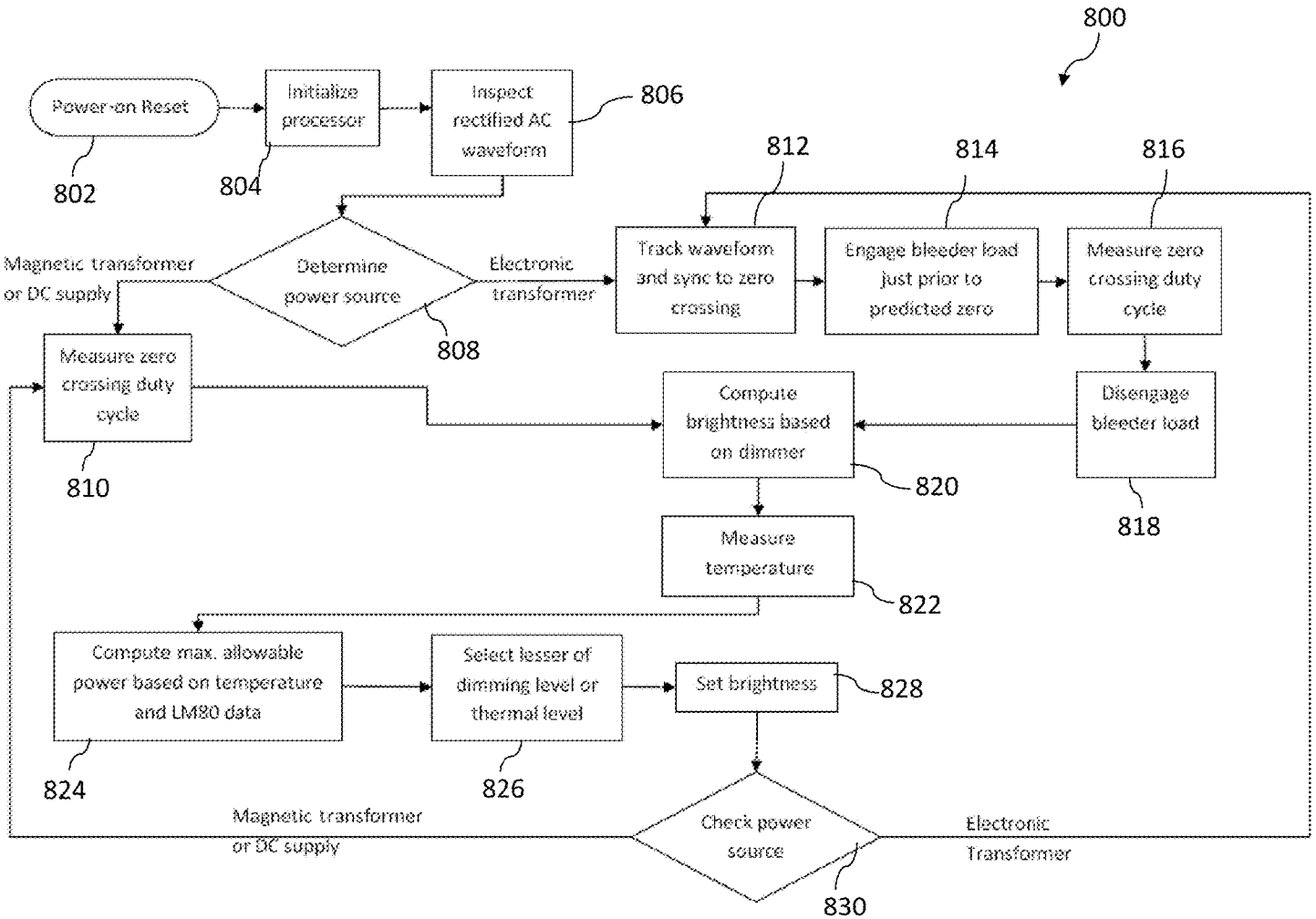
FIG. 8 is a flowchart of a method for controlling an LED module in accordance with embodiments of the invention.

Some or all of the above circuits may be used in a manner illustrated in a flowchart 800 shown in FIG. 8. The processor 616 is powered on (Step 802), using its own power supply or a power supply shared with one of the other components in the LED module 600. The processor 616 is initialized (Step 804) using techniques known in the art, such as by setting or resetting control registers to known values. The processor 616 may wait to receive acknowledgement signals from other components on the LED module 600 before leaving initialization mode.

The processor 616 inspects the incoming rectified AC waveform 618 (Step 806) by observing a few cycles of it. As described above, the analyzer 702 may detect a frequency of the input signal 618 and determine the type of power source (Step 808) based thereon. If the supply is a magnetic transformer, the processor 616 measures the zero-crossing duty cycle (Step 810) of the input waveform (i.e., the processor 616 detects the point where the input waveform crosses zero and computes the duty cycle of the waveform based thereon). If the supply is an electronic transformer, the processor 616 tracks the waveform 618 and syncs to the zero crossing (Step 812). In other words, the processor 616 determines which zero crossings are the result of the high-frequency electronic transformer output and which zero crossings are the result of the transformer output envelop changing polarity; the processor 616 disregards the former and tracks the latter. In one embodiment, the processor 616 engages a bleeder load just prior to a detected zero crossing (Step 814) in order to prevent a potential ULDT condition from influencing the duty cycle computation. The duty cycle is then measured (Step 816) and the bleeder load is disengaged (Step 818).

At this point, whether the power supply is a DC supply or a magnetic or electronic transformer, the processor 616 computes a desired brightness level based on a dimmer (Step 820), if a dimmer is present. Furthermore, if desired, a temperature of the LEDs may be measured (Step 822). Based on the measured temperature and LED manufacturing data, the processor 616 computes a maximum allowable power for the LED (Step 824). The dimmer level and thermal level are analyzed to compute a net brightness level; in one embodiment, the lesser of the two is selected (Step 826). The brightness of the LED is then set with the computed brightness level (Step 828). Periodically, or when a change in the input signal 618 is detected, the power supply type may be checked (Step 830), the duty cycle of the input, dimming level, and temperature are re-measured and a new LED brightness is set.

Certain embodiments of the present invention were described above. It is, however, expressly noted that the present invention is not limited to those embodiments, but rather the intention is that additions and modifications to what was expressly described herein are also included within the scope of the invention. Moreover, it is to be understood that the features of the various embodiments described herein were not mutually exclusive and can exist in various combinations and permutations, even if such combinations or permutations were not made express herein, without departing from the spirit and scope of the invention. In fact, variations, modifications, and other implementations of what was described herein will occur to those of ordinary skill in the art without departing from the spirit and the scope of the invention. As such, the invention is not to be defined only by the preceding illustrative description.

What is claimed is:

1. An apparatus comprising:

an analyzer for determining a transformer type based at least in part on a power signal received from a transformer, wherein the determined transformer type corresponds to a magnetic transformer or an electronic transformer; and a generator for generating a control signal, based at least in part on the determined transformer type, to instruct a regulator IC to operate in one of a plurality of operating modes in accordance with the transformer type, wherein the plurality of operating modes comprise a first mode for accepting a low-frequency input voltage and a second mode for accepting a high-frequency input voltage;

wherein the apparatus is a processor, microprocessor, application-specific integrated circuit, or field-programmable gate array.

2. The apparatus of claim 1, wherein the determined transformer type comprises a manufacturer or a model of the transformer.

3. The apparatus of claim 1, further comprising an input/output port for communicating with at least one of the analyzer and the generator.

4. The apparatus of claim 1, wherein the analyzer comprises a frequency analyzer for determining a frequency of the power signal.

5. The apparatus of claim 1, further comprising a dimmer control circuit for modifying the control signal in accordance with a dimmer setting.

6. The apparatus of claim 1, further comprising a bleeder control circuit for maintaining the transformer in an operating region by causing a load of the transformer to increase.

7. The apparatus of claim 1, further comprising a thermal control circuit for modifying the control signal in accordance with an over-temperature condition.

8. The apparatus of claim 1, wherein the generated control signal comprises a voltage control signal, a current control signal, or a pulse-width-modulated control signal.

* * * * *